US008535100B2

(12) United States Patent
Ge et al.

(10) Patent No.: US 8,535,100 B2
(45) Date of Patent: Sep. 17, 2013

(54) ELECTRICAL CONNECTOR WITH INDUCTANCE AND CONTACT MODULE USED IN THE ELECTRICAL CONNECTOR

(75) Inventors: Lin-Zhong Ge, Kunshan (CN); Yueh-Shan Shih, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 269 days.

(21) Appl. No.: 12/975,332

(22) Filed: Dec. 21, 2010

(65) Prior Publication Data

US 2011/0151717 A1 Jun. 23, 2011

(51) Int. Cl.
*H01R 13/66* (2006.01)

(52) U.S. Cl.
USPC ..... 439/620.17

(58) Field of Classification Search
USPC ..... 439/620.06, 620.07, 620.11, 620.12, 439/620.17
See application file for complete search history.

(56) References Cited

U.S. PATENT DOCUMENTS

| | | | | |
|---|---|---|---|---|
| 5,781,091 | A * | 7/1998 | Krone et al. | 336/200 |
| 5,825,259 | A | 10/1998 | Harpham | |
| 5,959,846 | A * | 9/1999 | Noguchi et al. | 361/782 |
| 6,102,741 | A * | 8/2000 | Boutros et al. | 439/620.06 |
| 6,176,741 | B1 * | 1/2001 | Shutter | 439/620.16 |
| 6,612,871 | B1 * | 9/2003 | Givens | 439/620.17 |
| 6,811,442 | B1 * | 11/2004 | Lien et al. | 439/620.07 |
| 6,835,098 | B1 * | 12/2004 | Chang | 439/620.06 |
| 6,926,558 | B2 * | 8/2005 | Sasai et al. | 439/620.04 |
| 6,964,585 | B2 * | 11/2005 | Blichasz et al. | 439/638 |
| 6,986,684 | B1 * | 1/2006 | Lien | 439/620.07 |
| 7,153,158 | B1 * | 12/2006 | Lee | 439/541.5 |
| 7,153,163 | B2 * | 12/2006 | Lewis et al. | 439/620.11 |
| 7,314,387 | B1 * | 1/2008 | Liu et al. | 439/620.11 |
| 7,485,004 | B2 * | 2/2009 | Liu et al. | 439/620.25 |
| 7,611,383 | B1 * | 11/2009 | Huang | 439/620.17 |
| 7,661,994 | B2 * | 2/2010 | Machado et al. | 439/676 |
| 7,708,594 | B2 * | 5/2010 | Xu | 439/620.05 |
| 7,785,135 | B2 * | 8/2010 | Wu | 439/490 |
| 7,841,902 | B2 * | 11/2010 | Chow et al. | 439/620.15 |
| 7,841,908 | B2 * | 11/2010 | Shen et al. | 439/676 |
| 7,993,163 | B2 * | 8/2011 | Wu et al. | 439/620.06 |
| 8,152,567 | B2 * | 4/2012 | Wu et al. | 439/620.06 |
| 8,162,695 | B2 * | 4/2012 | Zhang et al. | 439/620.22 |
| 8,187,037 | B2 * | 5/2012 | Mo | 439/620.07 |
| 8,203,418 | B2 * | 6/2012 | Harrison et al. | 336/200 |
| 8,251,744 | B2 * | 8/2012 | Huang et al. | 439/607.01 |
| 8,272,898 | B2 * | 9/2012 | Chow et al. | 439/620.15 |

(Continued)

FOREIGN PATENT DOCUMENTS

| | | | |
|---|---|---|---|
| CN | 1185692 | A | 6/1998 |
| CN | 200959439 | Y | 10/2007 |

*Primary Examiner* — Neil Abrams
(74) *Attorney, Agent, or Firm* — Wei Te Chung; Ming Chieh Chang

(57) ABSTRACT

An electrical connector (100) to be mounted on an exterior PCB (126) is disclosed. The electrical connector includes an insulating housing (120) having a front face defining a mating port (122) to receive a plug therein; a number of mating contacts (142) received in said insulating housing and extending into said mating port for mating with a plug inserted therein; a first internal PCB (144) having a front face on which said mating contacts are mounted; a second internal PCB (145) with a ferromagnetic core embedded therein and forming an inductance; a number of terminals (149) extending out to be mounted to said exterior PCB. A number of signal channels are formed between the mating contacts (142) and the terminals (149) with the inductance electrically connected therein.

9 Claims, 17 Drawing Sheets

(56) References Cited

U.S. PATENT DOCUMENTS

| | | | | |
|---|---|---|---|---|
| 2003/0211782 | A1* | 11/2003 | Esparaz et al. | 439/620 |
| 2004/0012933 | A1 | 1/2004 | Lewis | |
| 2004/0110422 | A1 | 6/2004 | Sasai | |
| 2007/0063807 | A1 | 3/2007 | Quilici | |
| 2007/0111598 | A1 | 5/2007 | Quilici | |
| 2008/0186124 | A1 | 8/2008 | Schaffer | |
| 2008/0214058 | A1 | 9/2008 | Machado | |
| 2008/0305692 | A1* | 12/2008 | Little et al. | 439/676 |
| 2009/0002111 | A1 | 1/2009 | Harrison | |
| 2009/0176408 | A1 | 7/2009 | Wu | |
| 2011/0122589 | A1* | 5/2011 | Wu et al. | 361/760 |
| 2011/0151717 | A1* | 6/2011 | Ge et al. | 439/620.07 |
| 2012/0058676 | A1* | 3/2012 | Schaffer et al. | 439/620.21 |

* cited by examiner

ELECTRICAL CONNECTOR WITH INDUCTANCE AND CONTACT MODULE USED IN THE ELECTRICAL CONNECTOR

CROSS-REFERENCE TO RELATED APPLICATIONS

This patent application is related to a U.S. patent application Ser. No. 12/951,099, filed on Oct. 20, 2010, assigned to the same assignee with this application and entitled "MAGNETIC ELEMENT HAVING IMPROVED TRANSFORMERS AND COMMOM MODE CHOKES".

BACKGROUND OF THE INVENTION

1. Field of the Invention

The present invention relates to an electrical connector having inductance, and particularly, to a contact module having inductance for noise filtering used in the electrical connector.

2. Description of Related Art

U.S. Pat. No. 5,825,259, issued to Harpham on Oct. 20, 1998, discloses an inductance for noise filtering. U.S. Pat. No. 5,781,091, issued to Krone et. al. on Jul. 14, 1998, discloses an inductance fabricated by PWB technology with ferromagnetic core embedded in PCB, which has stable electrical performance. U.S. Pat. No. 6,926,558 issued to Sasai on Aug. 9, 2005 discloses a modular jack having noise filtering inductance.

However, there is no solution for noise filtering inductances with stable electrical performance used in an electrical connector of low profile.

SUMMARY OF THE INVENTION

An object of the present invention is to provide an electrical connector to be mounted on an exterior PCB, the electrical connector comprising an insulating housing having a front face defining a mating port to receive a plug therein; a plurality of mating contacts received in said insulating housing and extending into said mating port for mating with a plug inserted therein; a first internal PCB having a front face on which said mating contacts are mounted; a second internal PCB with a ferromagnetic core embedded therein and forming an inductance; a plurality of terminals extending out to be mounted to said exterior PCB, wherein signal channels being formed between the mating contacts and the terminals with said inductance electrically connected therein.

Still another object of the present invention is to provide a contact module to be used in a receptacle connector, the contact module comprising a plurality of mating contacts for mating with a plug inserted into the receptacle connector; a first internal PCB having a front face on which said mating contacts are mounted; a second internal PCB stacked behind the first internal PCB, the second PCB having a ferromagnetic core embedded therein, a plurality of printed circuits formed on opposite side faces thereof, and a plurality of conductors extending there through and electrically connecting said printed circuits to form circuits winding around the ferromagnetic core, thereby forming an inductance.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
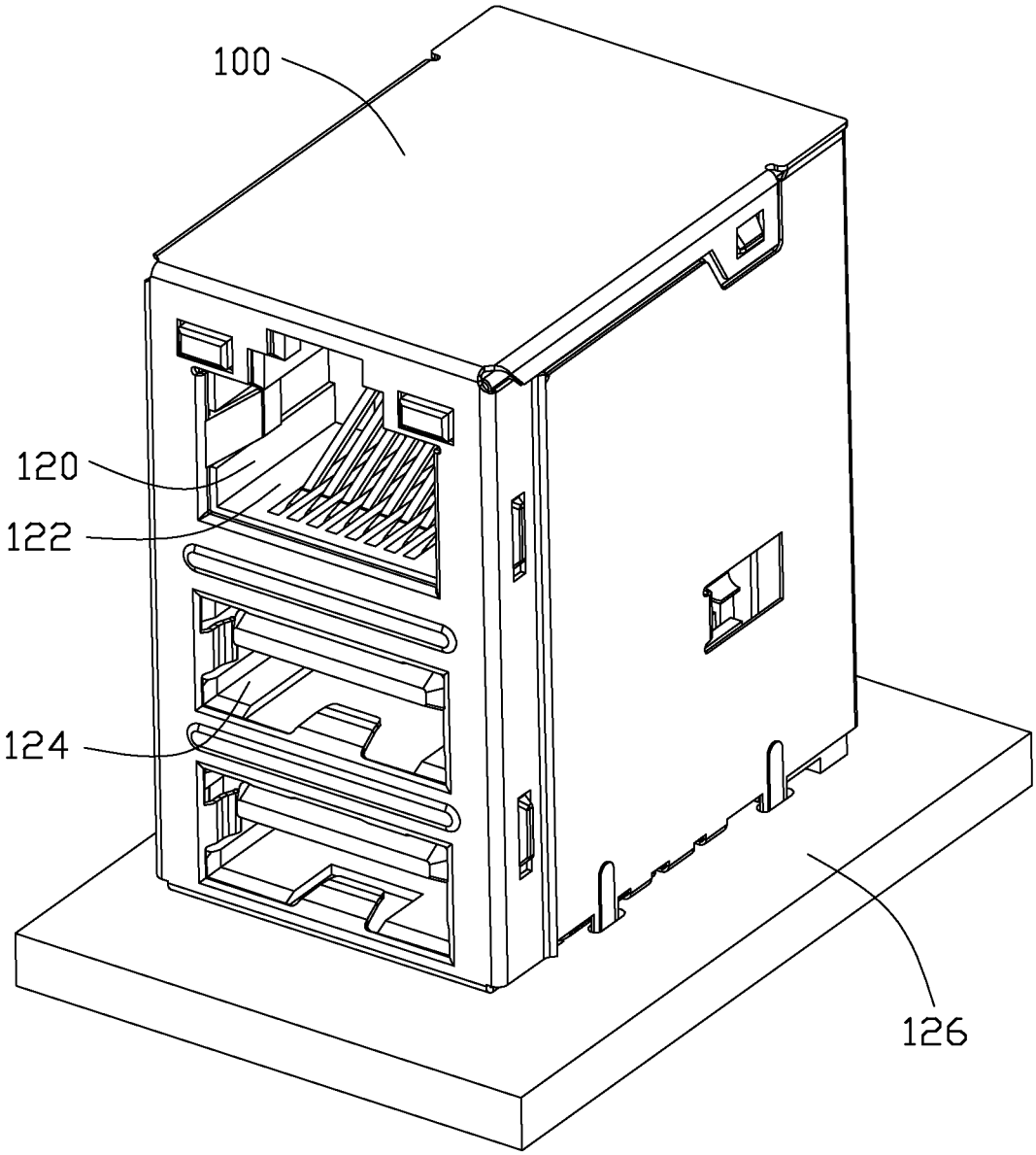
FIG. 1 is a perspective view of an electrical connector according to a first embodiment of the present invention.

Reference will now be made to the drawing figures to describe the present invention in detail.

Referring to FIG. 1, an electrical connector 100 mounted on an exterior PCB 126 is shown. The electrical connector has two stacked USB interfaces and a RJ45 interface 122 stacking on the two stacked USB interfaces 124.

Figure 2:
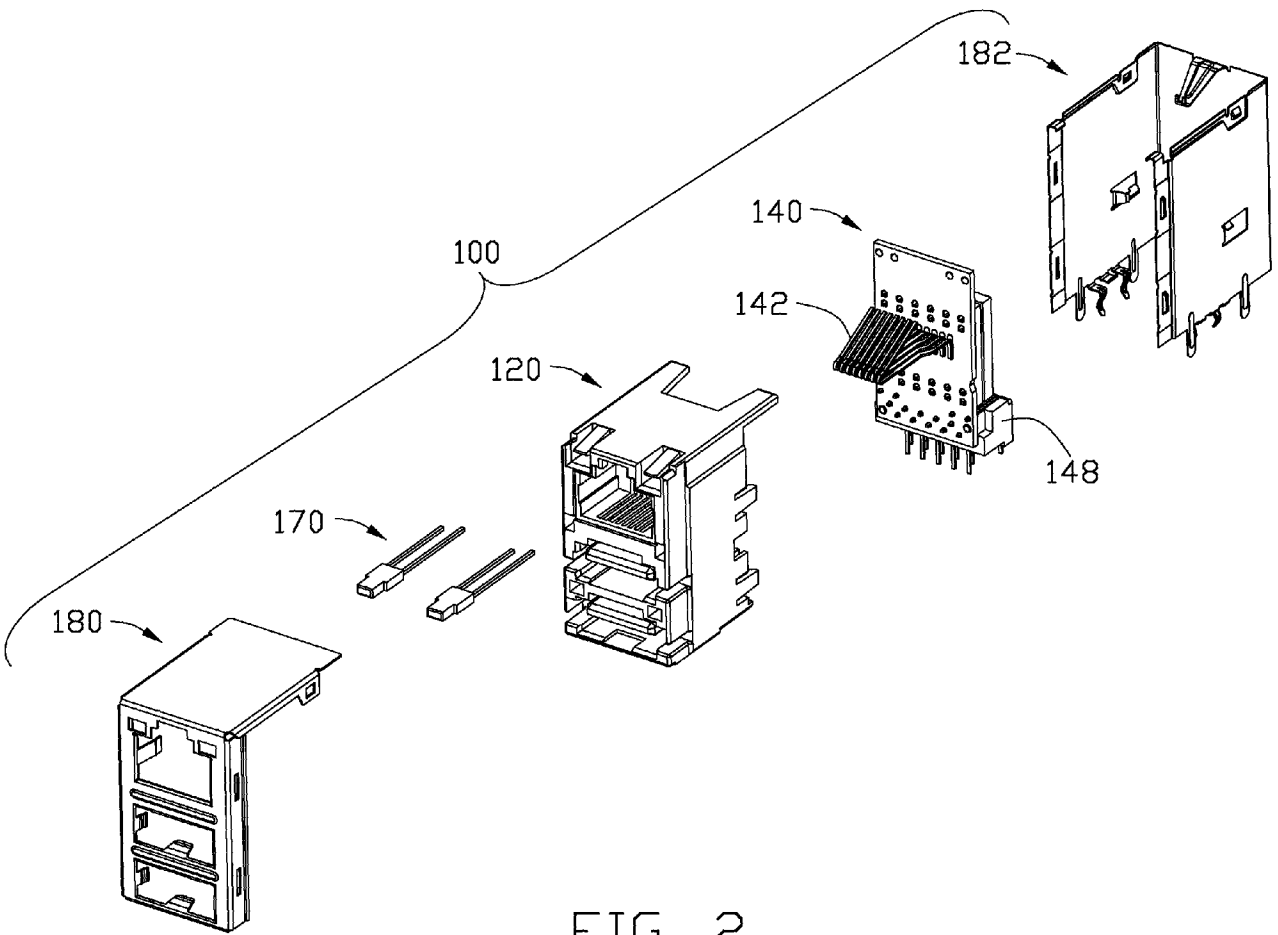
FIG. 2 is an exploded view of the electrical connector shown in FIG. 1.
Figure 3:
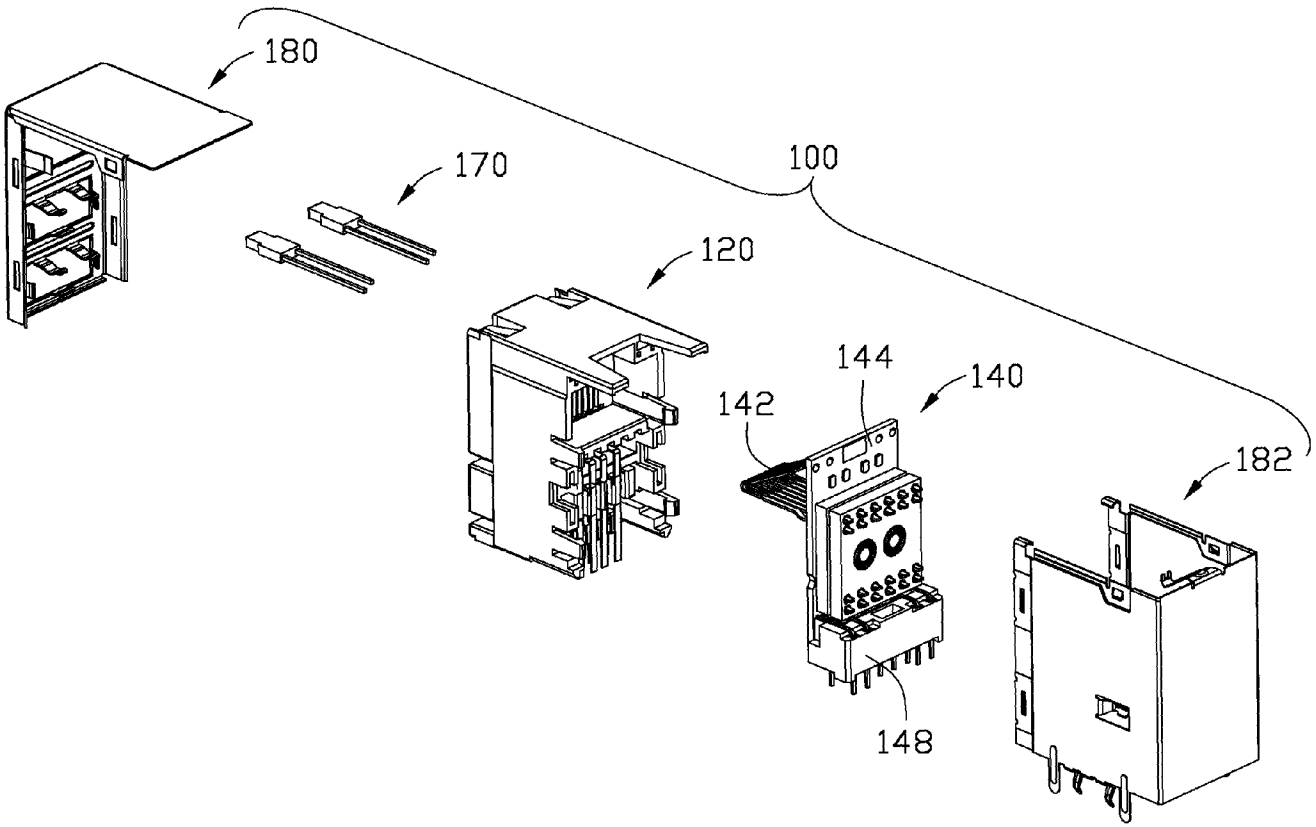
FIG. 3 is another exploded view of the electrical connector shown in FIG. 1.

Referring to FIGS. 2 and 3, the electrical connector 100 comprises an insulating housing 120, a contact module 140 received in the insulating housing 120, outer shells 180, 182 cooperatively covering the insulating housing 120 and the contact module 140. The insulating housing 120 has a front face defining mating ports to receive a RJ45 plug and two USB plug (not shown) therein.

Figure 4:
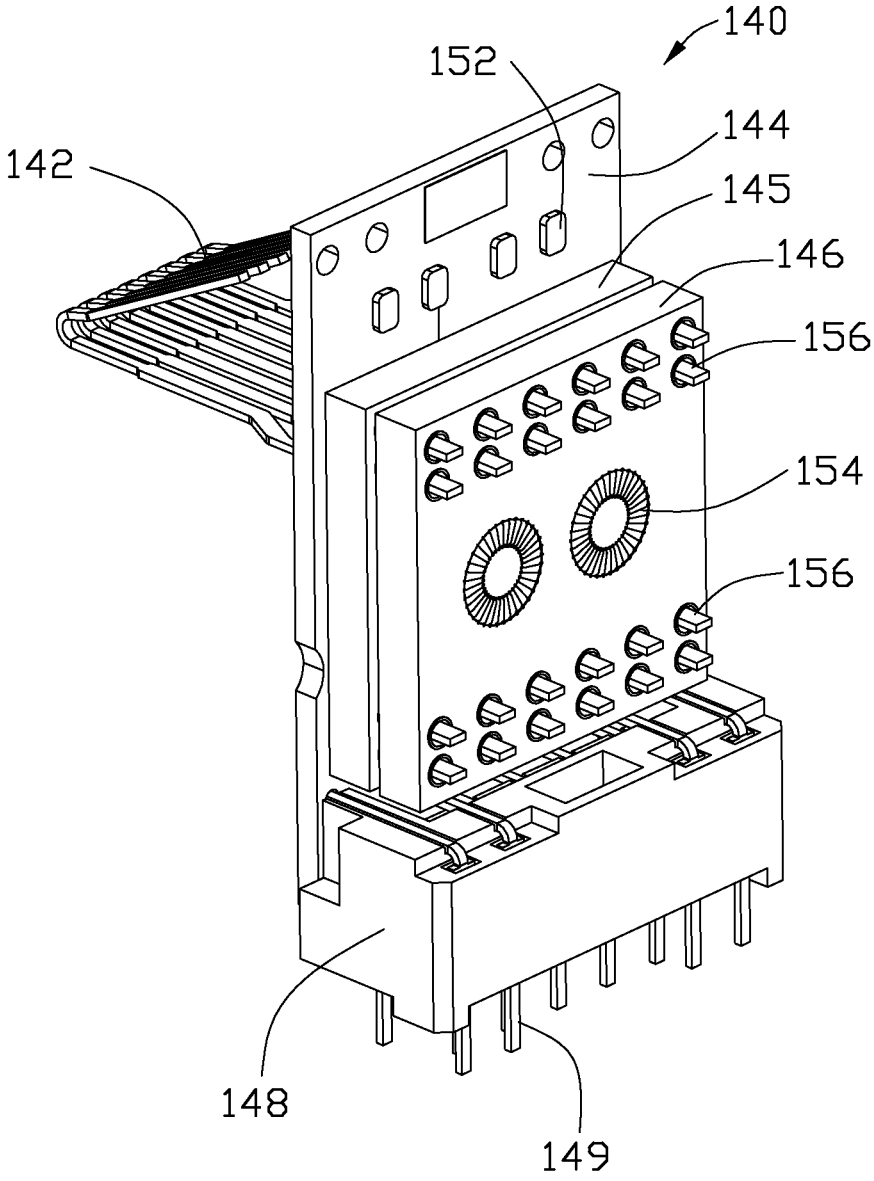
FIG. 4 is a perspective view of a contact module shown in FIG. 3.
Figure 5:
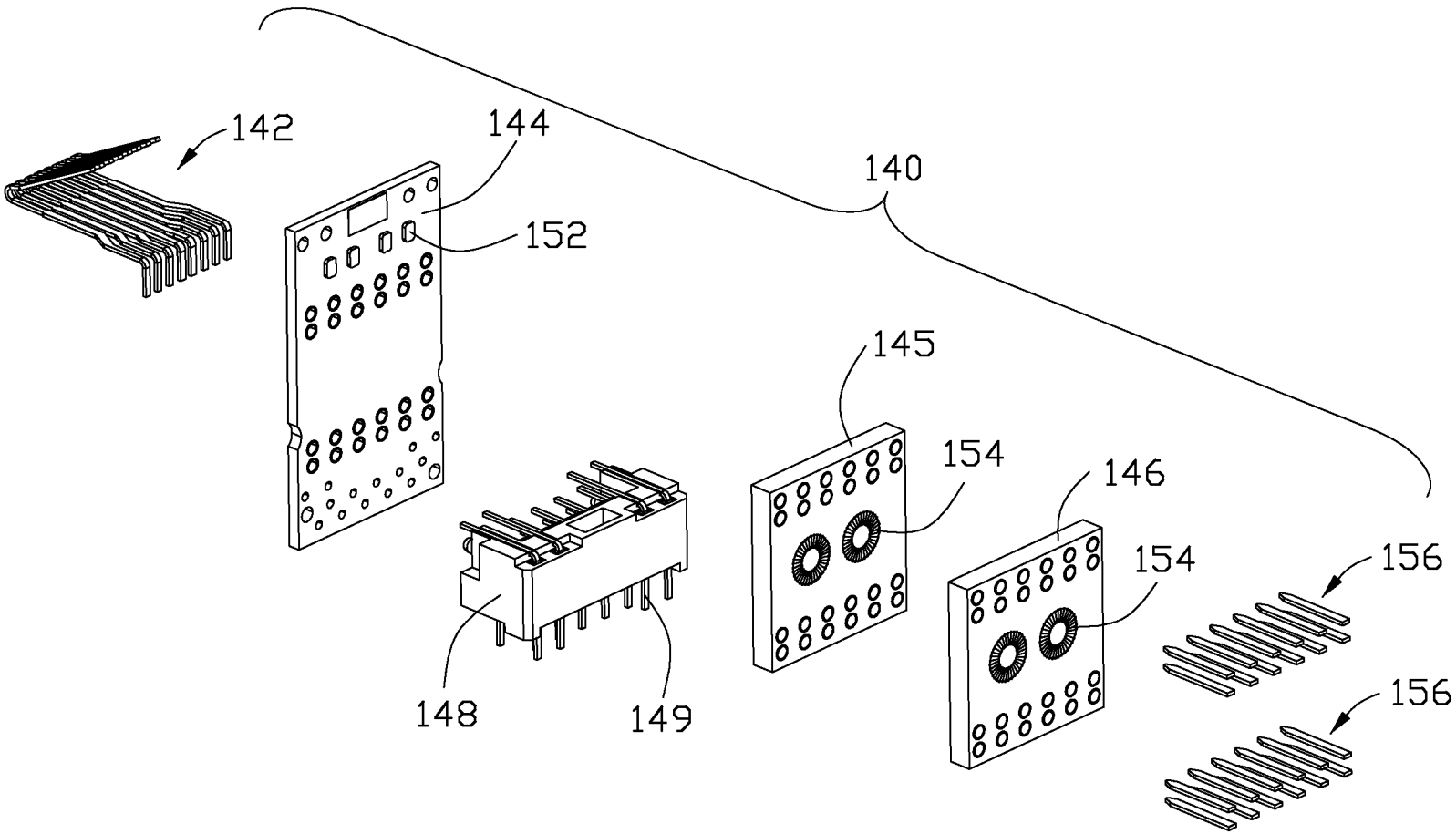
FIG. 5 is an exploded view of the contact module shown in FIG. 4.

Referring to FIGS. 4 and 5, the contact module 140 according to a first embodiment of the present invention comprises a plurality of mating contacts 142 for mating with a plug inserted into RJ45 interface 122; a first internal PCB 144 having a front face on which the mating contacts 142 are mounted; a second internal PCB 145 with two ferromagnetic cores (not shown) embedded therein; a third internal PCB 145 with another two ferromagnetic cores (not shown) embedded therein; a plurality of conductive pins 156 mechanically and electrically connecting the first internal PCB 144, the second internal PCB 145 and the third internal PCB 146; a plurality of terminals 149 mounted to the first internal PCB 144. The second internal PCB 145 has a plurality of printed circuits formed on opposite side faces thereof and a plurality of conductors (not shown) extending there through and electrically connecting said printed circuits. The printed circuits and the conductors form circuits winding around the two ferromagnetic cores respectively, thereby forming two isolating transformers 154. The third internal PCB 146 has a plurality of printed circuits formed on opposite side faces thereof and a plurality of conductors (not shown) extending there through and electrically connecting said printed circuits. The printed circuits and the conductors form circuits winding around the two ferromagnetic cores respectively, thereby forming another two isolating transformers 154. The contact module 140 further includes four surface-mount-type common mode chokes 152. The four common mode chokes 152 are mounted onto a rear face of the first internal PCB 145 through surface mount technology (SMT).

Figure 6:
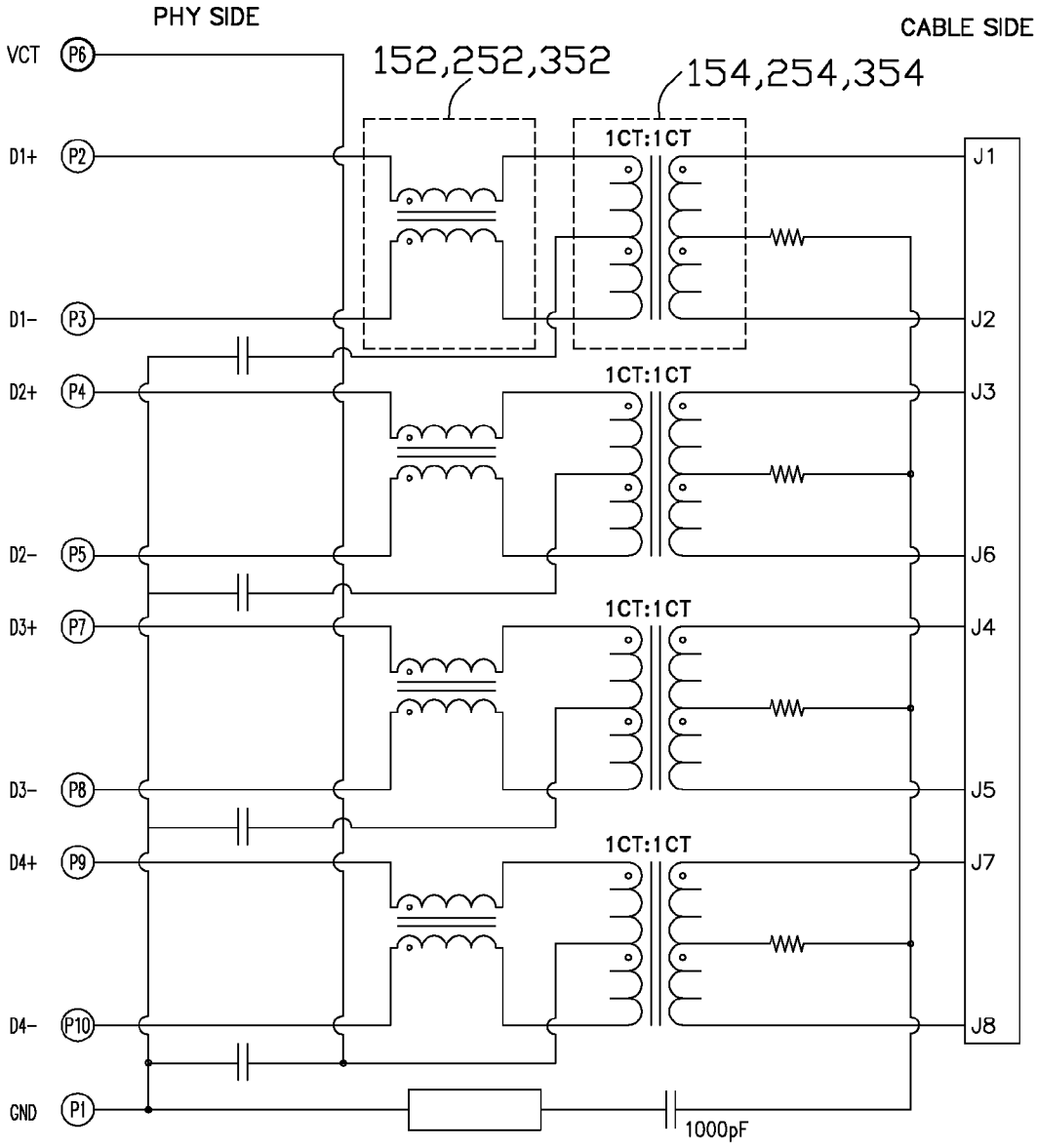
FIG. 6 is a circuit diagram of the contact module shown in FIG. 3.

Referring to FIG. 6, the circuit diagram of the contact module 140 is shown. The contact module 140 forms four signal channels between the mating contacts 142 and the terminals 149 with the four transformers 152 and the four common mode chokes 154 electrically connected therein, respectively. The terminals 149 act as physical side (PHY SIDE) and the mating contacts 142 act as cable side of the four signal channels, wherein the transformers 154 have a function of isolating noise originated from the cable side or the physical side and the common mode chokes 152 have a function of filtering common mode noise. Each of the signal channels has one said transformer 154 and one said common mode choke 152 serially connected therein.

Figure 7:
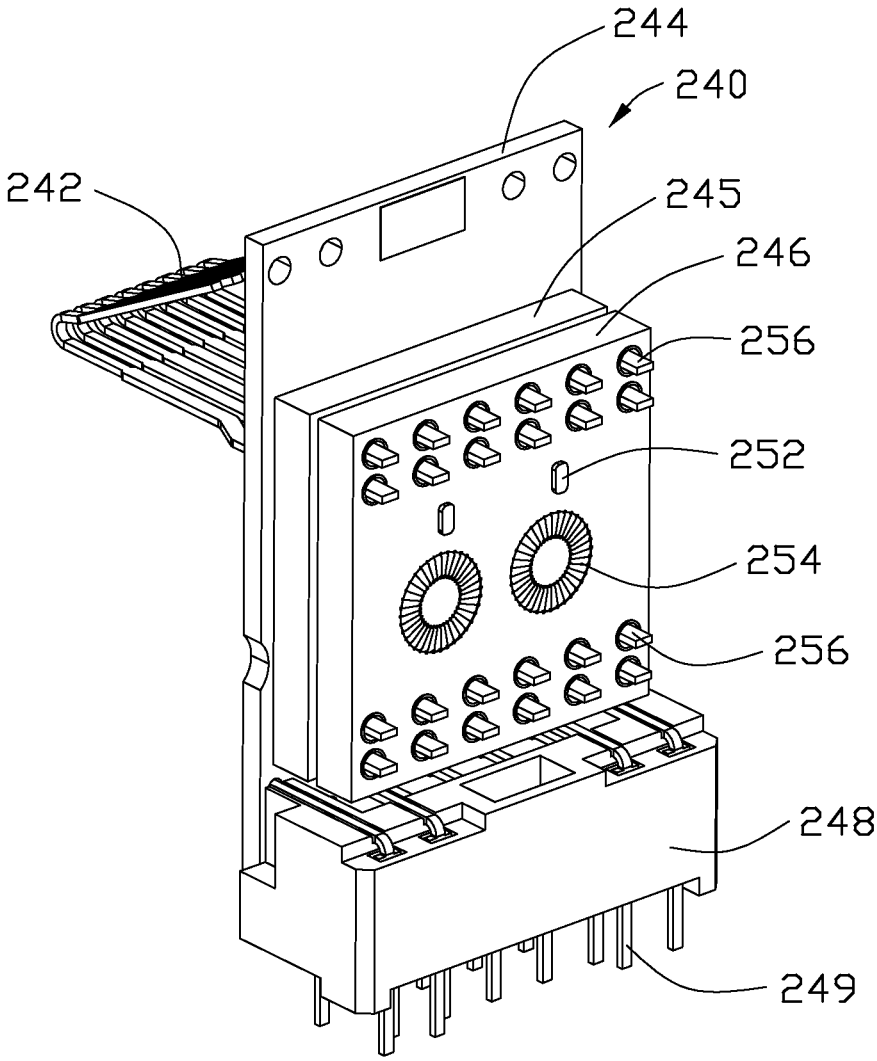
FIG. 7 is a perspective view of a contact module according to a second embodiment of the present invention.
Figure 8:
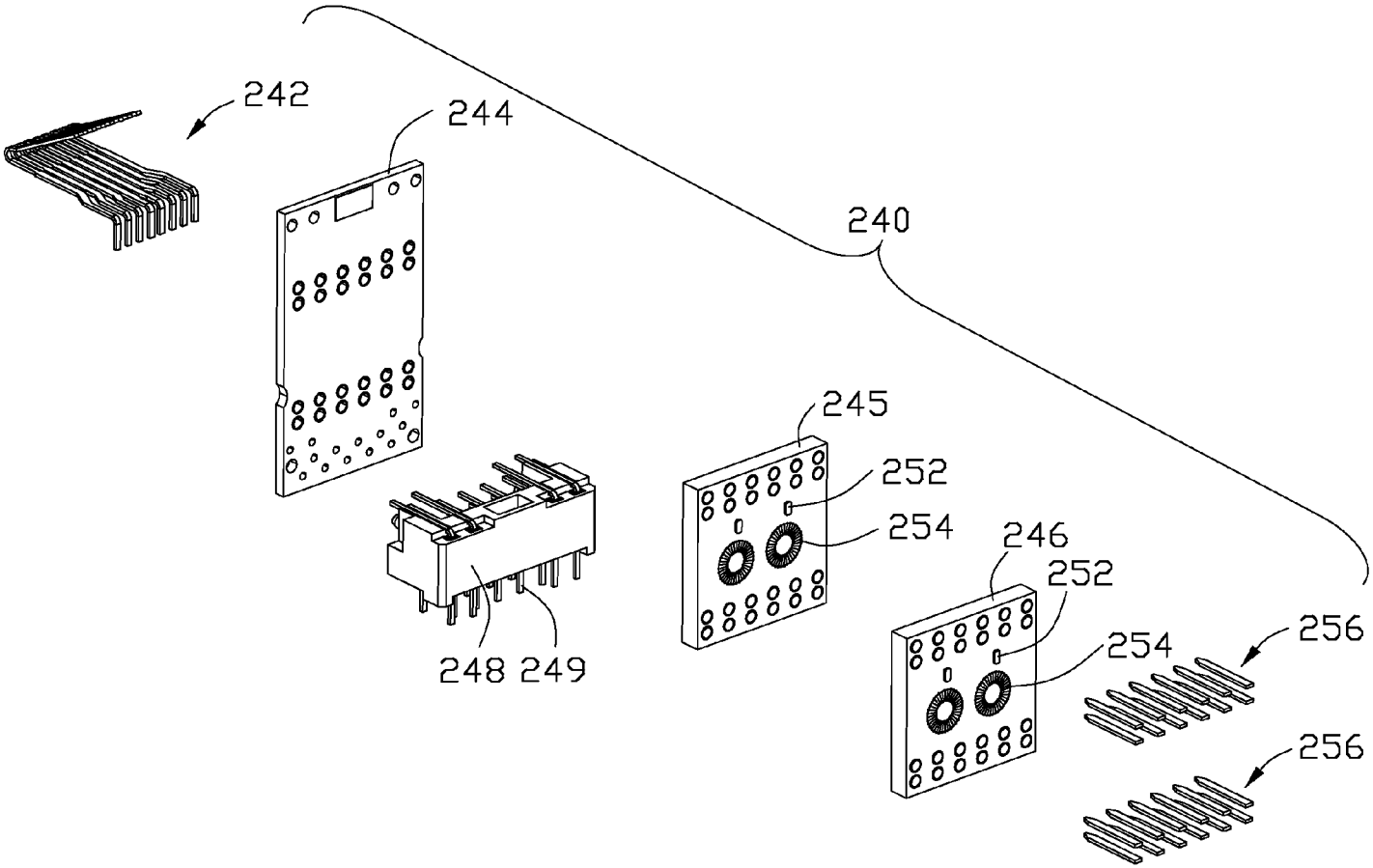
FIG. 8 is an exploded view of the contact module shown in FIG. 7.

Referring to FIGS. 7 and 8, the contact module 240 according to a second embodiment of the present invention comprises a plurality of mating contacts 242 for mating with a plug inserted into RJ45 interface 122; a first internal PCB 244 having a front face on which the mating contacts 242 are mounted; a second internal PCB 245 with two ferromagnetic cores (not shown) embedded therein; a third internal PCB 246 with two ferromagnetic cores (not shown) embedded therein; a plurality of conductive pins 256 mechanically and electrically connecting the first internal PCB 244, the second internal PCB 245 and the third internal PCB 246; a plurality of terminals 249 mounted to the first internal PCB 244. The second internal PCB 245 has a plurality of printed circuits formed on opposite side faces thereof and a plurality of conductors (not shown) extending there through and electrically connecting said printed circuits. The printed circuits and the conductors form circuits winding around the two ferromagnetic cores respectively, thereby forming two isolating transformers 254. The third internal PCB 246 has a plurality of printed circuits formed on opposite side faces thereof and a plurality of conductors (not shown) extending there through and electrically connecting said printed circuits. The printed circuits and the conductors form circuits winding around the two ferromagnetic cores respectively, thereby forming another two isolating transformers 254. The contact module 240 further includes four surface-mount-type common mode chokes 252. The four common mode chokes 252 are mounted onto rear faces of the second internal PCB 245 and third internal PCB 246 through SMT.

Referring back to FIG. 6, the circuit diagram of the contact module 240 according to the second embodiment of the present invention is the same as the circuit diagram of the first embodiment.

Figure 9:
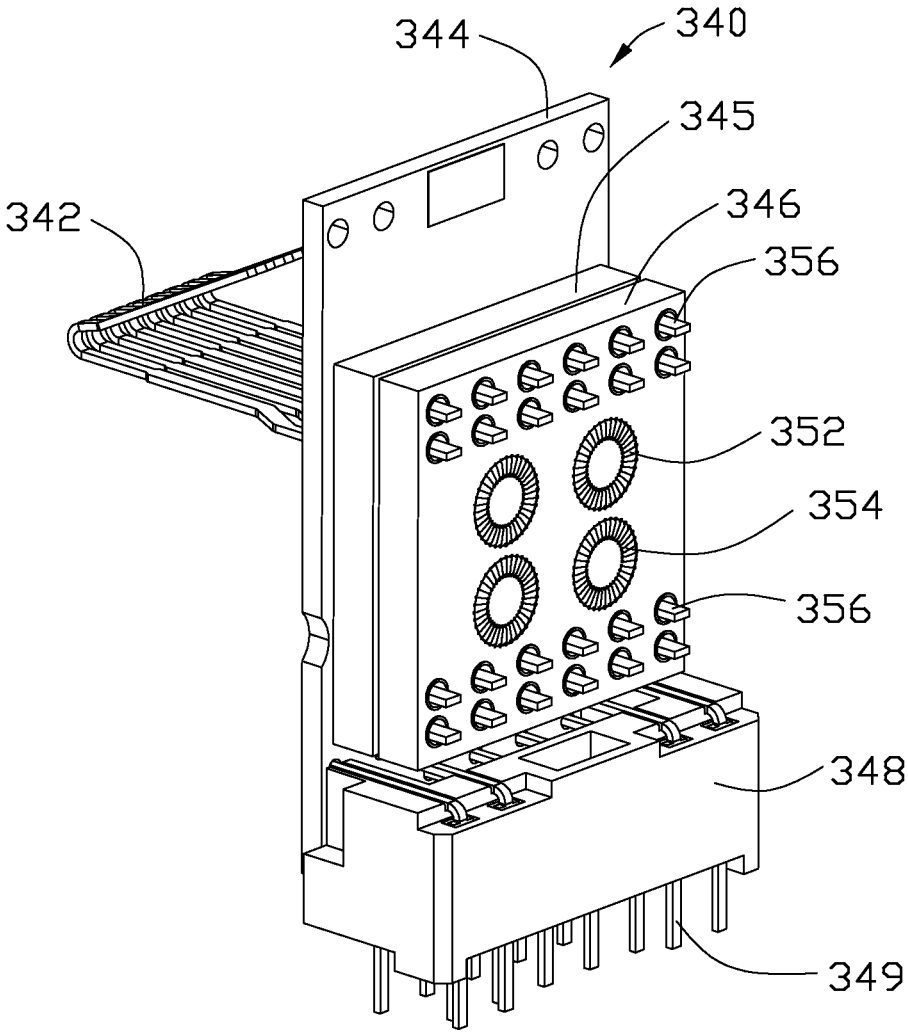
FIG. 9 a perspective view of a contact module according to a third embodiment of the present invention.
Figure 10:
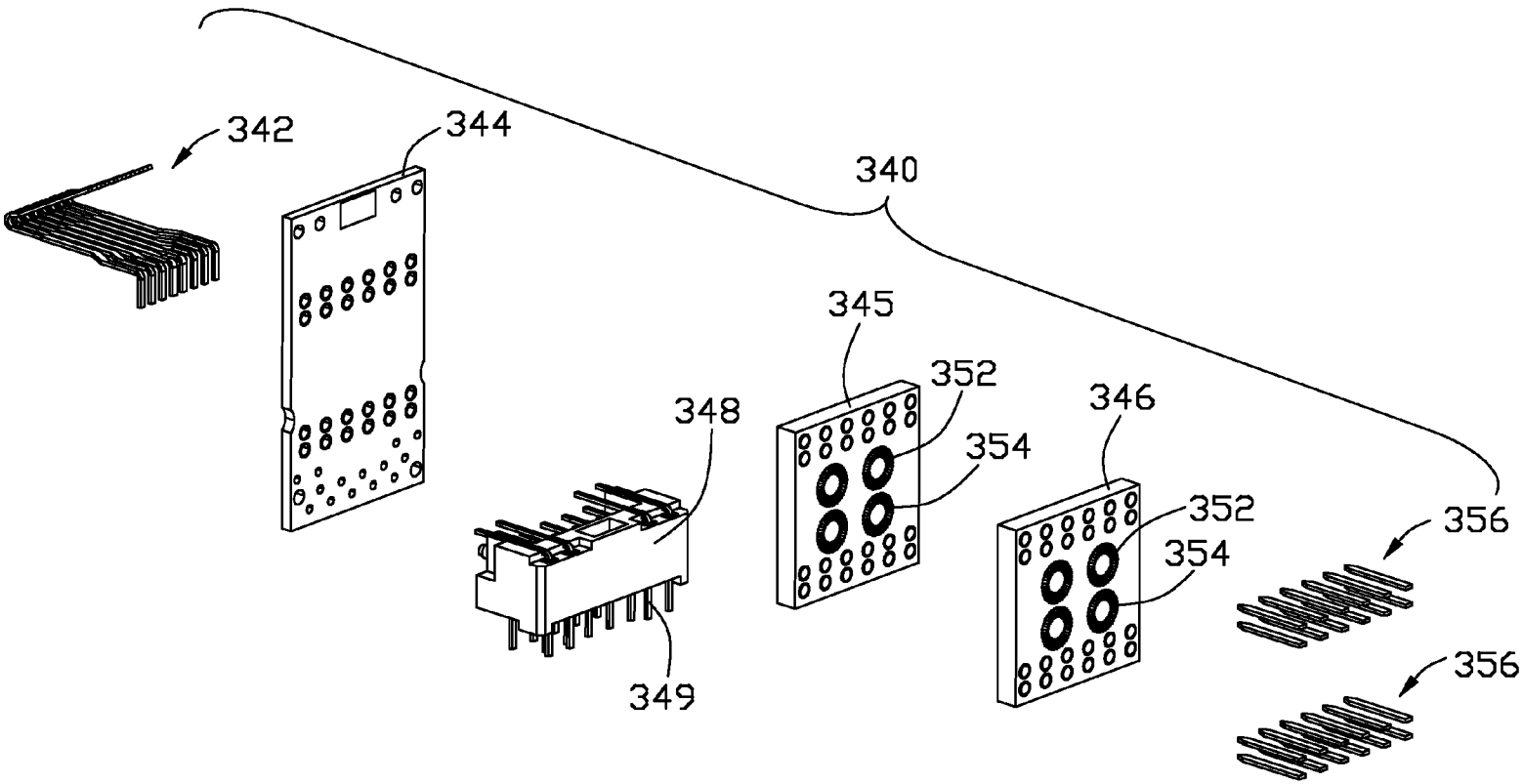
FIG. 10 is an exploded view of the contact module shown in FIG. 10.

Referring to FIGS. 9 and 10, the contact module 340 according to a third embodiment of the present invention comprises a plurality of mating contacts 342 for mating with a plug inserted into RJ45 interface 122; a first internal PCB 344 having a front face on which the mating contacts 342 are mounted; a second internal PCB 345 with four ferromagnetic cores (not shown) embedded therein; a third internal PCB 346 with four ferromagnetic cores (not shown) embedded therein; a plurality of conductive pins 356 mechanically and electrically connecting the first internal PCB 344, the second internal PCB 345 and the third internal PCB 346; a plurality of terminals 349 mounted to the first internal PCB 344. The second internal PCB 345 has a plurality of printed circuits formed on opposite side faces thereof and a plurality of conductors (not shown) extending there through and electrically connecting said printed circuits. The printed circuits and the conductors form circuits winding around the four ferromagnetic cores respectively, thereby forming two isolating transformers 354 and two common mode chokes 352. The third internal PCB 346 has a plurality of printed circuits formed on opposite side faces thereof and a plurality of conductors (not shown) extending there through and electrically connecting said printed circuits. The printed circuits and the conductors form circuits winding around the four ferromagnetic cores respectively, thereby forming another two isolating transformers 354 and two common mode chokes 352.

Referring back to FIG. 6, the circuit diagram of the contact module 340 according to the third embodiment of the present invention is the same as the circuit diagram of the first embodiment.

Figure 11:
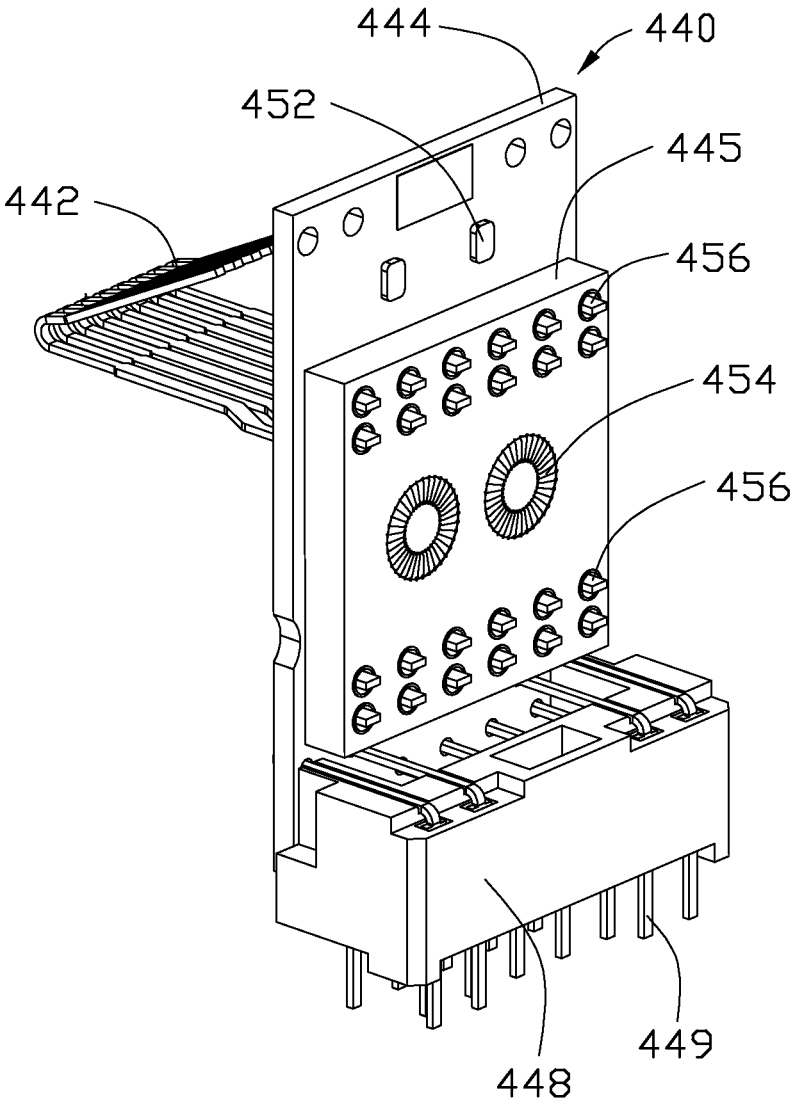
FIG. 11 is a perspective view of a contact module according to a fourth embodiment of the present invention.
Figure 12:
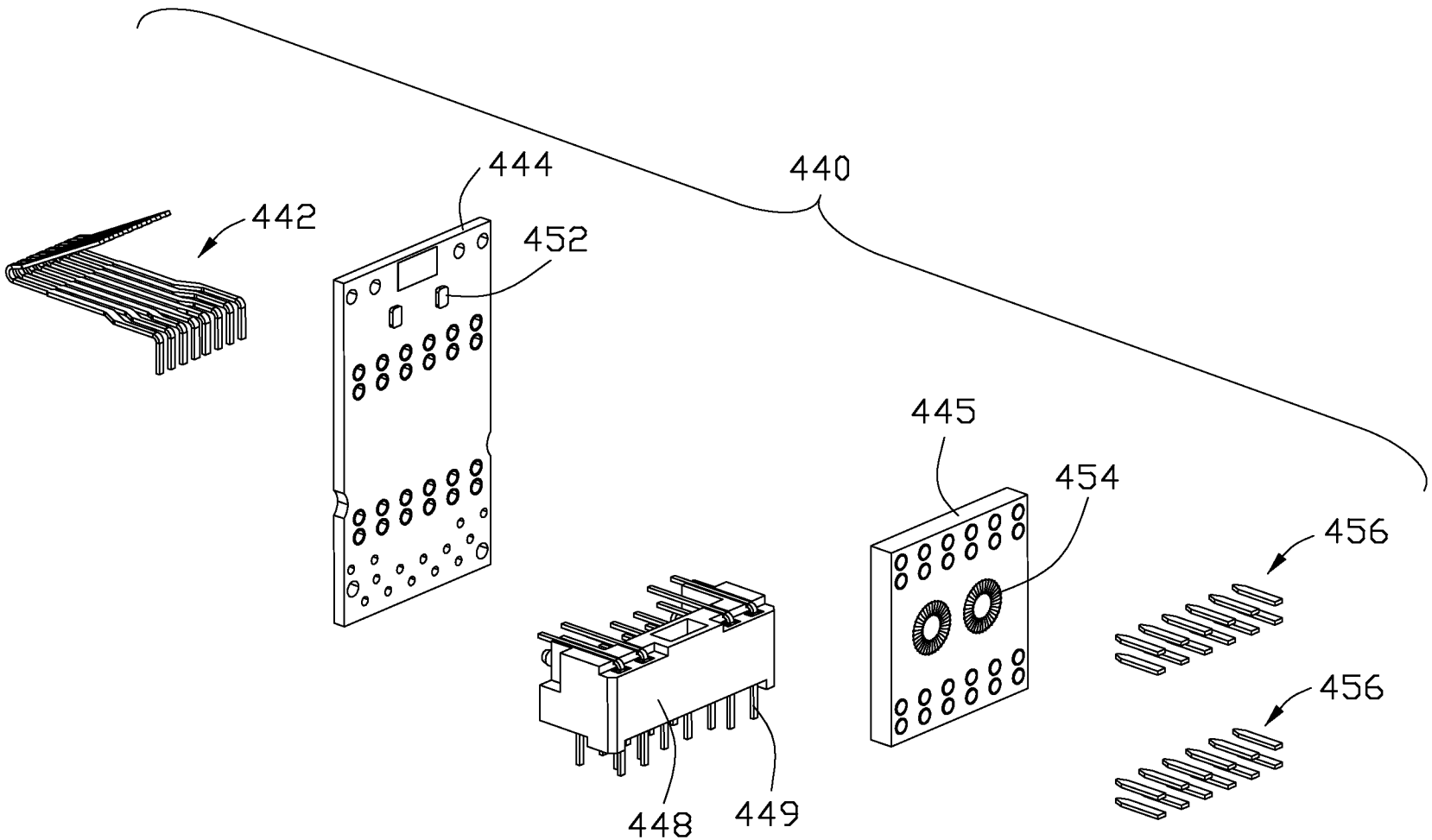
FIG. 12 is an exploded view of the contact module shown in FIG. 12.

Referring to FIGS. 11 and 12, the contact module 440 according to a fourth embodiment of the present invention comprises a plurality of mating contacts 442 for mating with a plug inserted into RJ45 interface 122; a first internal PCB 444 having a front face on which the mating contacts 442 are mounted; a second internal PCB 445 with two ferromagnetic cores (not shown) embedded therein; a plurality of conductive pins 456 mechanically and electrically connecting the first internal PCB 444 and the second internal PCB 445; a plurality of terminals 449 mounted to the first internal PCB 444. The second internal PCB 445 has a plurality of printed circuits formed on opposite side faces thereof and a plurality of conductors (not shown) extending there through and electrically connecting said printed circuits. The printed circuits and the conductors form circuits winding around the two ferromagnetic cores respectively, thereby forming two isolating transformers 454. The contact module 440 further includes two surface-mount-type common mode chokes 452. The two common mode chokes 452 are mounted onto a rear face of the first internal PCB 445.

Figure 13:
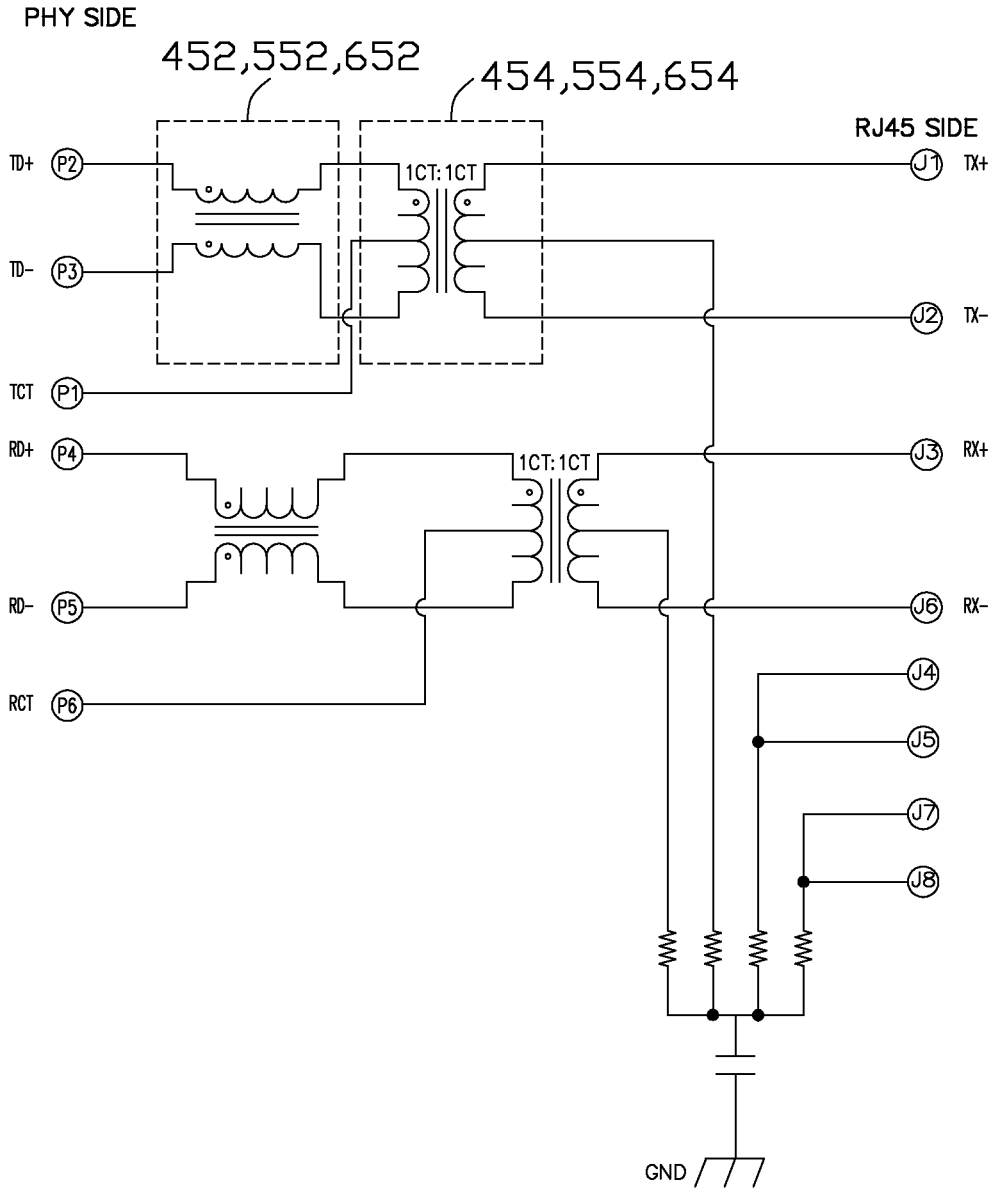
FIG. 13 is a circuit diagram of the contact module shown in FIG. 11.

Referring to FIG. 13, the circuit diagram of the contact module 440 according to a fourth embodiment of the present invention is shown. The contact module 440 forms two signal channels between the mating contacts 442 and the terminals 449 with the two isolating transformers 452 and the two common mode chokes 454 electrically connected therein, respectively. The terminals 449 act as physical side (PHY SIDE) and the mating contacts 442 act as cable side of the four signal channels, wherein the transformers 454 have a function of isolating noise originated from the cable side or the physical side and the common mode chokes 452 have a function of filtering common mode noise. Each of the signal channels has one said transformer 454 and one said common mode choke 452 serially connected therein.

Figure 14:
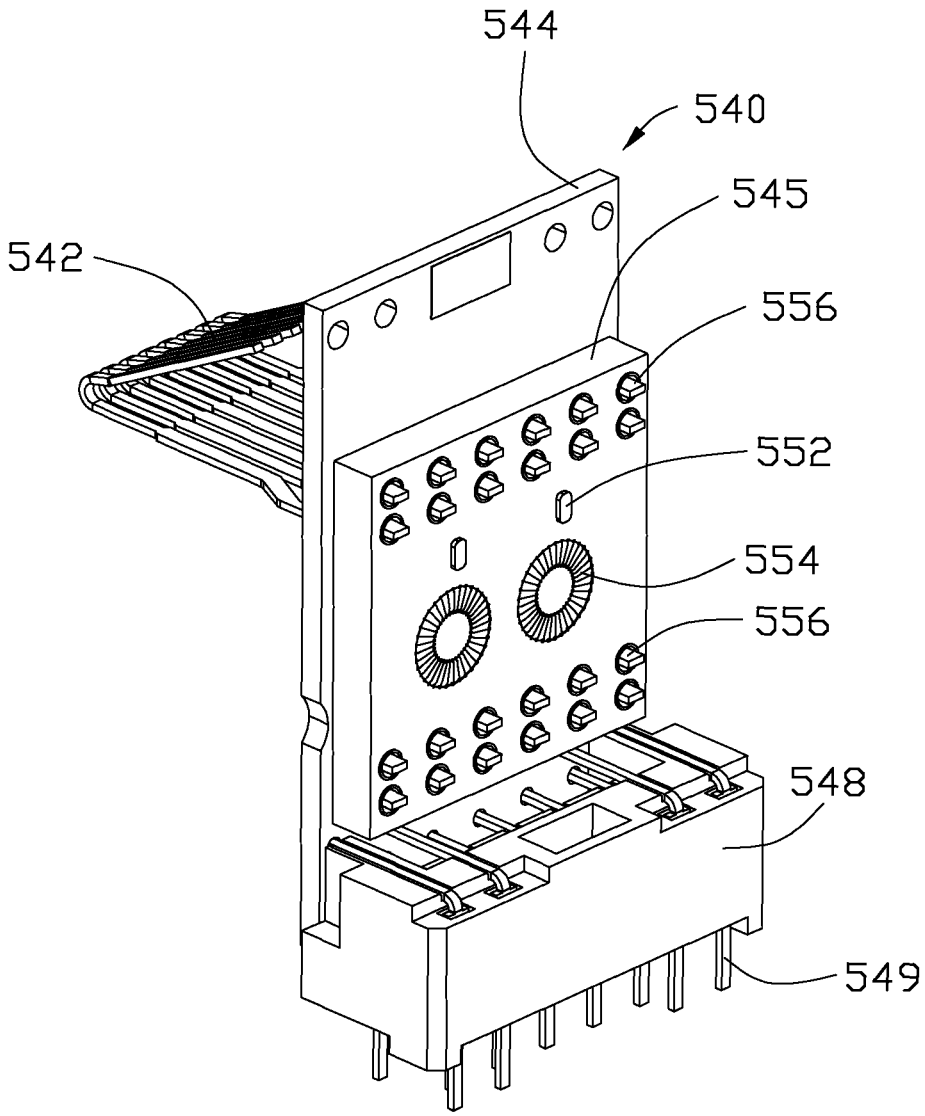
FIG. 14 is a perspective view of a contact module according to a fifth embodiment of the present invention.
Figure 15:
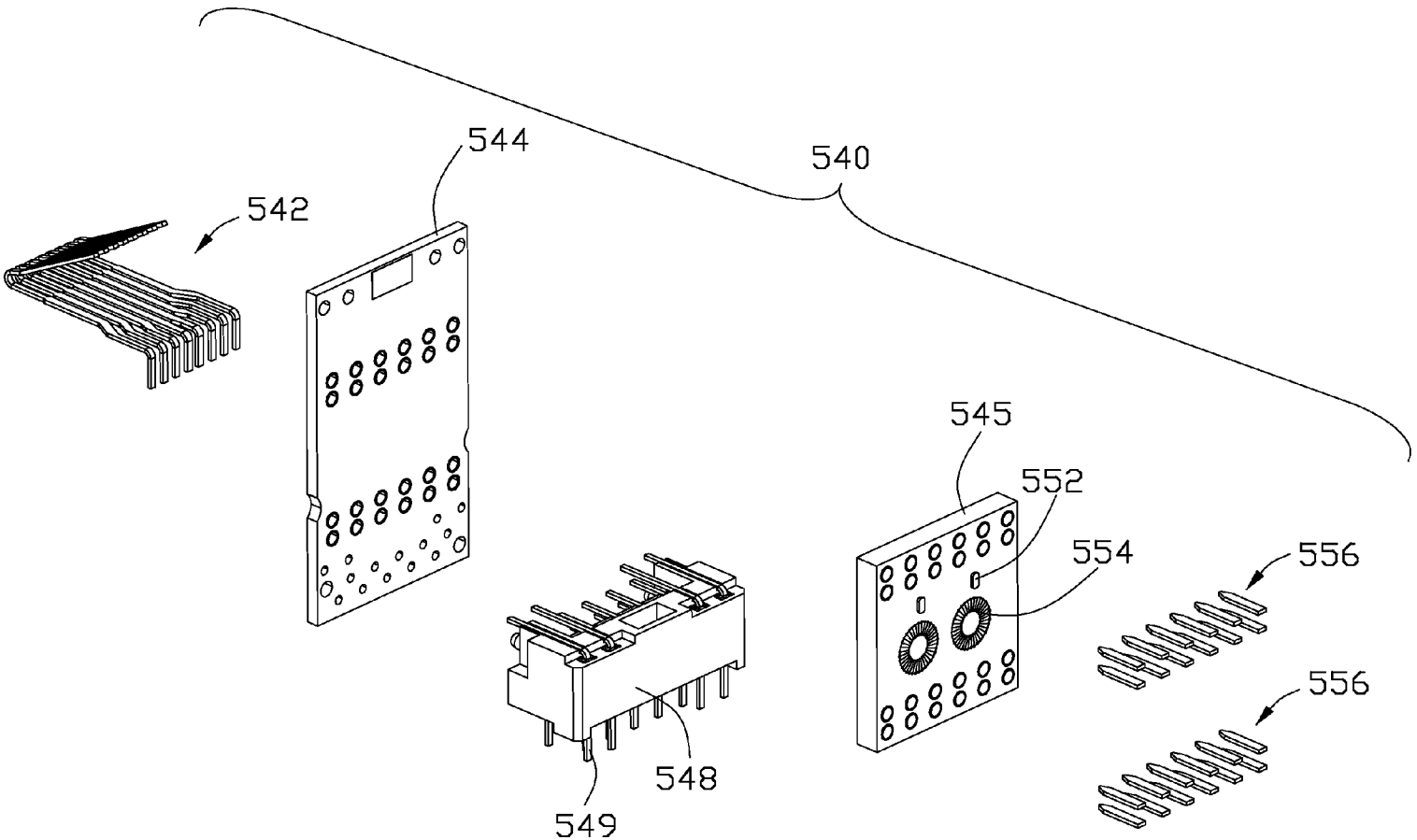
FIG. 15 is an exploded view of the contact module shown in FIG. 14.

Referring to FIGS. 14 and 15, the contact module 440 according to a fifth embodiment of the present invention comprises a plurality of mating contacts 542 for mating with a plug inserted into RJ45 interface 122; a first internal PCB 544 having a front face on which the mating contacts 542 are mounted; a second internal PCB 545 with two ferromagnetic cores (not shown) embedded therein; a plurality of conductive pins 556 mechanically and electrically connecting the first internal PCB 544 and the second internal PCB 545; a plurality of terminals 549 mounted to the first internal PCB 544. The second internal PCB 545 has a plurality of printed circuits formed on opposite side faces thereof and a plurality of conductors (not shown) extending there through and electrically connecting said printed circuits. The printed circuits and the conductors form circuits winding around the two ferromagnetic cores respectively, thereby forming two isolating transformers 554. The contact module 540 further includes two surface-mount-type common mode chokes 552. The two common mode chokes 552 are mounted onto a rear face of the first internal PCB 545.

Referring back to FIG. 13, the circuit diagram of the contact module 540 according to a fifth embodiment of the present invention is the same as the circuit diagram of the fourth embodiment.

Figure 16:
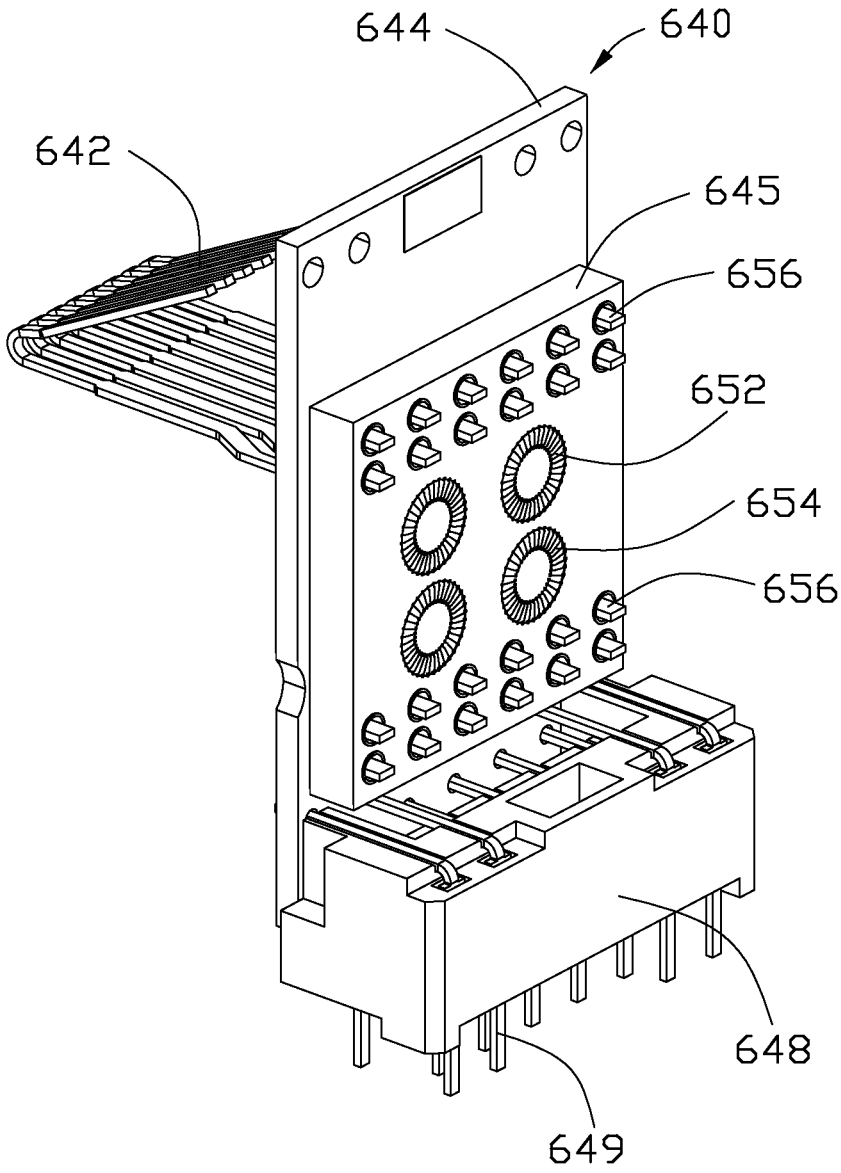
FIG. 16 is a perspective view of a contact module according to a sixth embodiment of the present invention.
Figure 17:
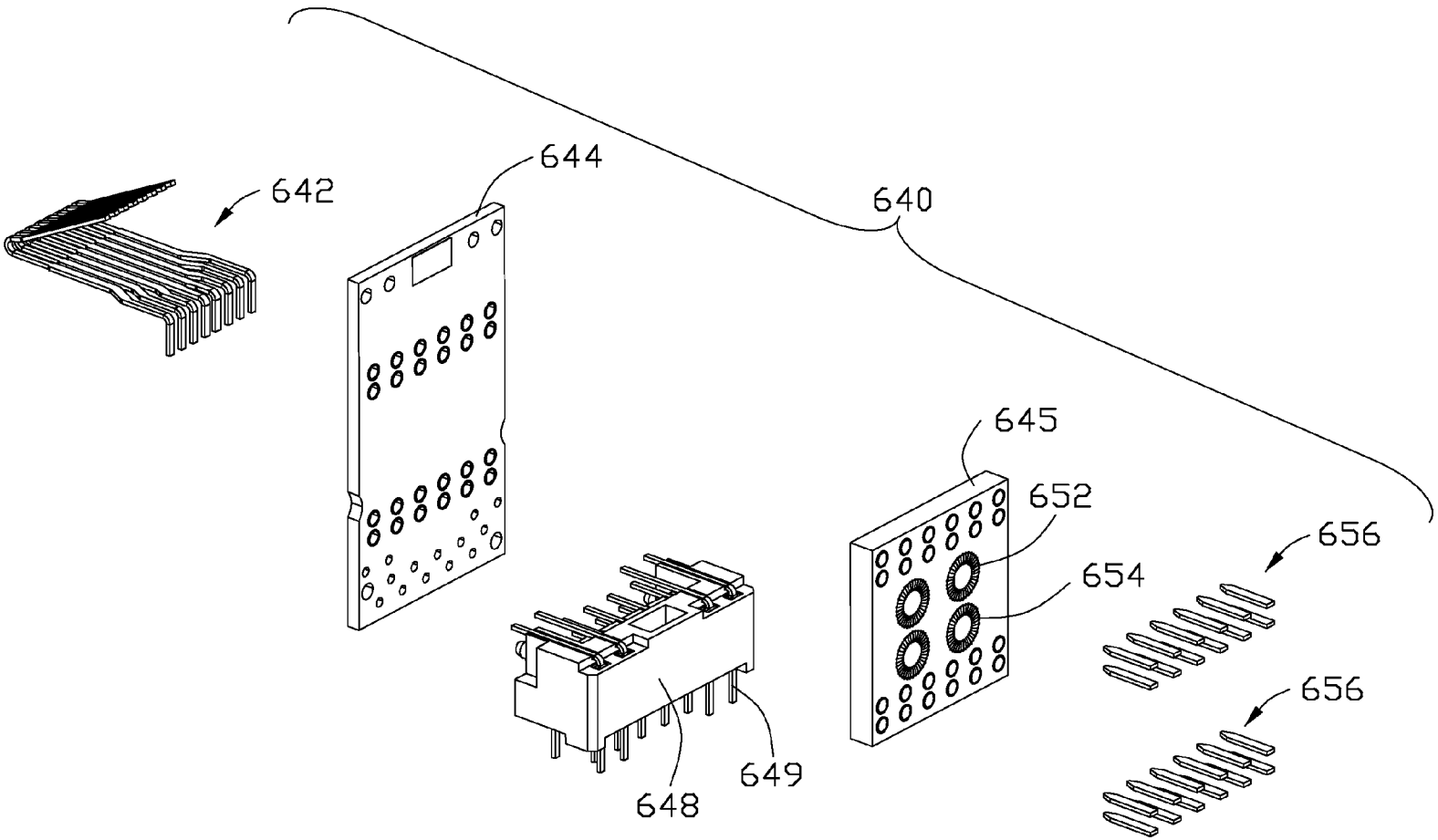
FIG. 17 is an exploded view of the contact module shown in FIG. 16.

Referring to FIGS. 16 and 17, the contact module 640 according to a fifth embodiment of the present invention comprises a plurality of mating contacts 642 for mating with a plug inserted into RJ45 interface 122; a first internal PCB 644 having a front face on which the mating contacts 642 are mounted; a second internal PCB 645 with four ferromagnetic cores (not shown) embedded therein; a plurality of conductive pins 656 mechanically and electrically connecting the first internal PCB 644 and the second internal PCB 645; a plurality of terminals 649 mounted to the first internal PCB 644. The second internal PCB 645 has a plurality of printed circuits formed on opposite side faces thereof and a plurality of conductors (not shown) extending there through and electrically connecting said printed circuits. The printed circuits and the conductors form circuits winding around the four ferromagnetic cores respectively, thereby forming two isolating transformers 654 and two common mode chokes 652.

Referring back to FIG. 13, the circuit diagram of the contact module 640 according to the sixth embodiment of the present invention is the same as the circuit diagram of the fourth embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact module for being used in a receptacle connector, comprising:

a plurality of mating contacts for mating with a plug that is inserted into the receptacle connector;

a first printed circuit board (PCB) having a front face on which said mating contacts are mounted, a rear face, and a common mode choke mounted on the rear face;

a second PCB being thicker than the first PCB and stacked behind the first PCB, the second PCB having an embedded transformer; and a plurality of terminals;

wherein a signal channel is formed between the mating contacts and the terminals through the common mode choke and the transformer; and wherein the first PCB is larger in size than the second PCB to have an additional area on which the common mode choke is mounted.

2. A PCB (printed circuit board) assembly for use with a modular jack, comprising:

a first PCB;

a second PCB stacked, in a front-to-back direction, behind the first PCB in a parallel relation;

a plurality of transformers embedded in the second PCB;

a first set of contacts located around a first region and extending through both said first and second PCBs; and a second set of contacts located around a second region and extending through both said first and second PCBs; wherein the first PCB is larger than the second PCB with comparably a first additional area on which a footer structure is mounted for connecting the first PCB to a main PCB, and a second addition area on which chokes are mounted.

3. The PCB assembly as claimed in claim 2, wherein each of the first set of contacts forwardly extends to provide an oblique resilient contacting section for mating with a plug.

4. The PCB assembly as claimed in claim 2, wherein said transformers are located between the first set of contacts and the second set of contacts in a vertical direction perpendicular to said front-to-back direction.

5. The PCB assembly as claimed in claim 2, wherein said first area is located on a lower portion of the first PCB while said second area is located on an upper portion of the first PCB.

6. The PCB assembly as claimed in claim 2, wherein a third PCB is stacked, in said front-to-back direction, behind the second PCB under condition that both said first set of contacts and said second set of contacts extend through said third PCB.

7. The PCB assembly as claimed in claim 6, wherein said third PCB further includes transformers embedded therein.

8. An electrical connector to be mounted on an exterior printed circuit board (PCB), comprising:

an insulating housing having a front mating port for receiving a plug;

a plurality of mating contacts received in said insulating housing and extending into said mating port for mating with a plug inserted therein;

a front PCB having a front face on which said mating contacts are mounted;

a rear PCB stacked behind the front PCB; and a plurality of terminals extending out to be mounted to said exterior PCB, wherein signal channels are formed between the mating contacts and the terminals, each of the signal channels having an embedded isolating transformer and a common mode choke connected therein, the common mode choke being surface mounted onto the front PCB;

wherein the front and the rear PCBs have a plurality of conductive holes receiving a plurality of conductive pins, each conductive pin having a front end connecting the front PCB and a rear end connecting the rear PCB;

wherein the front PCB is larger than the rear PCB to provide a lower area below the rear PCB receiving the terminals;

wherein the front PCB is larger than the rear PCB to provide an upper area above the rear PCB on which the common mode choke is mounted.

9. The electrical connector as claimed in claim 8, further comprising a third PCB, and wherein there are four signal channels, and each of the second and the third internal PCBs has two embedded transformers.

* * * * *